United States Patent [19]

Kaczur et al.

[11] 4,434,033

[45] Feb. 28, 1984

[54] PROCESS FOR PRODUCING CONCENTRATED SOLUTIONS CONTAINING ALKALI METAL CHLORATES AND ALKALI METAL CHLORIDES

[75] Inventors: Jerry J. Kaczur, Cleveland, Tenn.; Steven A. Iacoviello, West Haven; Edward G. Miller, Hamden, both of Conn.

[73] Assignee: Olin Corporation, New Haven, Conn.

[21] Appl. No.: 382,524

[22] Filed: May 27, 1982

[51] Int. Cl.[3] ..... C25B 1/26

[52] U.S. Cl. ..... 204/95; 137/5; 73/61.1 C

[58] Field of Search ..... 424/439; 137/5, 2; 73/61.1 C; 204/95

[56] References Cited

U.S. PATENT DOCUMENTS

| | | | |
|---|---|---|---|
| 1,143,586 | 6/1915 | Laib | 204/95 |
| 3,724,474 | 4/1973 | DeVale | 137/5 |
| 4,033,871 | 7/1977 | Wall | 137/5 |
| 4,172,773 | 10/1979 | Pellegri et al. | 204/95 |
| 4,308,124 | 12/1981 | Pellegri | 204/95 |
| 4,323,092 | 4/1982 | Zabel | 137/5 |

OTHER PUBLICATIONS

Wescan Ion Analyzer, No. Oct. 3, 1981, I. Molar, H. Knauer and D. Wilk, Journal of Chromatography, 201 (1980), pp. 225–240.

*Primary Examiner*—R. L. Andrews

*Attorney, Agent, or Firm*—James B. Haglind; Donald F. Clements

[57] ABSTRACT

A process for producing a concentrated aqueous solution of an alkali metal chlorate and an alkali metal chloride comprises feeding an aqueous alkali metal chloride solution to a first electrolysis zone at an initial feed rate. The aqueous alkali metal chloride is electrolyzed to produce a concentrated chlorate solution comprised of an alkali metal chlorate and the alkali metal chloride. A portion of the concentrated solution is fed to an analysis zone and analyzed to measure the ratio of the concentration of the chlorate ion to the concentration of the chloride ion. The measured ratio is compared in a processing zone with a predetermined value range for the ratio and, where the measured ratio falls outside of the predetermined value range, altering the initial feed rate of alkali metal chloride to the first electrolysis zone. The concentrated alkali metal is removed from the first electrolysis zone to a product solution collection zone.

The novel process of the present invention permits the continuous operation of the electrolytic cells by frequently and rapidly determining the chlorate and chloride concentrations by reverse phase liquid chromatography employing an ion pairing eluent solution. The process permits adjustments to the various feed streams to maintain the required ion concentrations without the long delays required by other processes while reducing the requirements for manual operators.

11 Claims, 2 Drawing Figures

PROCESS FOR PRODUCING CONCENTRATED SOLUTIONS CONTAINING ALKALI METAL CHLORATES AND ALKALI METAL CHLORIDES

This invention relates to an improved process for the electrolysis of alkali metal chloride brines. More particularly, the invention relates to the electrolysis of an alkali metal chloride brine to produce alkali metal chlorate solutions.

Alkali metal chlorates are produced commercially by the electrolysis of an aqueous alkali metal chloride solution in electrolytic cells. For example, where sodium chlorate is to be produced, sodium chloride brine is fed to one or more electrolytic cells and electrolyzed to produce a brine solution and $NaClO_3$. Where more than one cell is employed, the brine solution having a low concentration of $NaClO_3$is fed to a second cell in the series of electrolyzed to produce a brine having an increased concentration of sodium chlorate. The brine solution is then fed to the next cell in the series and further electrolyzed until a suitable concentration of sodium chlorate in the sodium chloride brine is produced. Sodium chlorate is then recovered, usually as a crystalline product, from the brine solution. Where the sodium chlorate is to be used, for example, in the production of chlorine dioxide, it is advantageous to recover the sodium chlorate in a brine solution containing controlled concentrations of sodium chloride. To continuously produce sodium chlorate-sodium chloride solutions having the desired ratios of chlorate ion to chloride ion, it is necessary to have available accurate analyses of the brine solutions. Until the novel process of the present invention, the brine solutions were analyzed by manually removing brine samples from the process streams and determining by manual methods such as titration, the chlorate-chloride concentrations. This analysis is difficult because of the high concentrations of the chlorate ions and chloride ions and is therefore time consuming and expensive. It has been proposed that the solution analysis be made employing an ion exchange column. However, as frequent regeneration of the columns was necessary and the samples to be analyzed required high dilution factors, this method was not found to be practical.

It is therefore an object of the present invention to provide a process for producing solutions containing alkali metal chlorates and alkali metal chlorides in desired ratios.

Another object of the present invention is to provide a process for the production of solutions containing alkali metal chlorates and alkali metal chlorides in which the concentration of chlorate ion and chloride ion can be rapidly and accurately determined.

A further object of the present invention is to provide a process for the production of solutions containing alkali metal chlorates and alkali metal chlorides having reduced requirements for manual operators.

These and other advantages of the present invention are accomplished in:

A process for producing a concentrated aqueous solution comprised of an alkali metal chlorate and an alkali metal chloride, the process which comprises:

feeding an aqueous alkali metal chloride solution to a first electrolysis zone at an initial feed rate;

electrolyzing the aqueous alkali metal chloride to produce a concentrated chlorate solution comprised of an alkali metal chlorate and the alkali metal chloride;

feeding a portion of the concentrated chlorate solution to an analysis zone;

analyzing the aqueous solution to measure the ratio of the concentration of the chlorate ion to the concentration of the chloride ion;

comparing in a processing zone the measured ratio with a predetermined value range for the ratio, and where the measured ratio falls outside of the predetermined value range for the ratio, altering the initial feed rate of the alkali metal chloride to the first electrolysis zone; and removing the concentrated alkali metal chlorate solution from the first electrolysis zone to a product solution collection zone.

Figure 1:
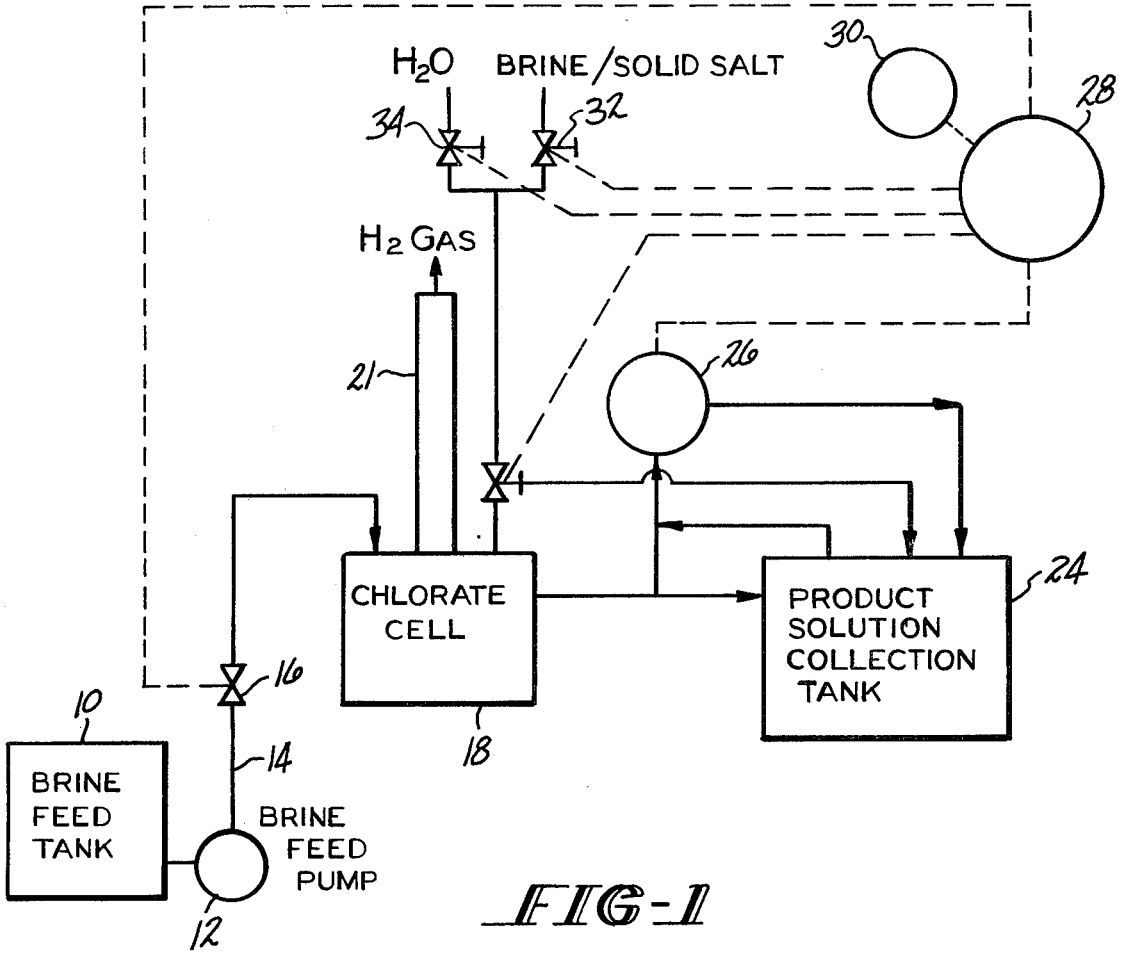
FIG. 1 represents a flow diagram of one embodiment of the process of the invention.

More in detail, in the process illustrated in FIG. 1, an alkali metal chloride brine is fed by pump 12 from brine feed tank 10 through line 14 containing valve 16 to electrolytic cell 18. In electrolytic cell 18, the alkali metal chloride is electrolyzed to produce chlorine, an alkali metal hydroxide and hydrogen. Reaction of the chlorine and alkali metal hydroxide initially takes place to produce hypochlorous acid and an alkali metal hypochlorite which subsequently react to produce an alkali metal chlorate. Hydrogen gas evolved is removed from the electrolyte solution through riser 21. The alkali metal chlorate solution produced in electrolytic cell 18 is fed to product solution collection tank 24. A portion of the alkali metal chlorate solution is pumped to analysis zone 26 where the concentrations of alkali metal chlorate and alkali metal chloride in the product solution are analyzed. The analytical results are fed to processor 28 which compares the concentration ratios of chlorate and chloride ions present with predetermined values required by the product solution. Where the concentration ratio of chlorate ions to chloride ions is outside of the predetermined values, processor 28 actuates valve 16 in line 14 to change the feed rate of alkali metal chloride brine from brine feed tank 10 to electrolytic cell 18. Upon comparison of the concentration ratio of the chlorate ions to chloride ions in the product from electrolytic cell 18, processor 28 may activate valve 32 to feed alkali metal chloride brine or solid alkali metal chloride salt to electrolytic cell 18, or alternately, to activate valve 34 to feed water to electrolytic cell 18. Chlorate solution in solution collection tank 24 can be fed to analyzer 26 for analysis of the chlorate/-chloride ion concentration ratio. Where the concentration ratio is outside of the predetermined values, controlled additions of brine or water may be made to solution collection tank 24 by means of processor 28. Processor 28 monitors the electrolytic cell current load by receiving a signal from rectifier 30. Processor compares the signal received with a predetermined value range for the current load. When the received signal falls outside of the predetermined current load value range, the processor adjusts brine feed value 16 or adjusts the current load directly by adjusting the rectifier control unit.

Sodium chlorate solutions containing sodium chloride are used in generators for chlorine dioxide, a bleaching and disinfecting agent employed, for example, in the textile and paper industries. The chlorate solutions are required to have controlled amounts of chloride ion which enhances the generation of chlorine dioxide gas when the chlorate ion is reacted with a reducing agent such as hydrochloric acid or sulfur dioxide. The amounts of chloride present in the soluble are controlled to provide suitable weight ratios of the chloride ion to the chlorate ion. In solutions commercially employed, for example, in the production of chlorine dioxide, the weight concentrations of sodium chlorate are at least 300 grams per liter and the sodium chloride concentration is at least 90 grams per liter and up to saturation values at the prevailing conditions. Weight concentration ratios of chlorate to chloride are in the range of about 1.2:1 to about 7.5:1, preferably from about 1.5:1 to about 6.5:1. For example, one mixture produced commercially has a weight concentration ratio of chlorate to chloride of about 6:1; another commercially available solution has a weight concentration ratio of chlorate to chloride of about 1.7:1.

While FIG. 1 illustrates a process in which a single cell is employed, commercial electrolytic processes may employ a series of cells in which the electrolyte is passed from cell to cell whereby the chlorate concentration in each succeeding cell in the series increases and the chloride concentration decreases. In addition to the concentration changes which occur as a result of the electrolysis, the solution concentrations are affected by evaporation and cooling which takes place during the process; the current load (in kiloamps, KA) passed through the cells, as well as the pH of the electrolyte in each electrolytic cell (the pH is adjusted by the addition of $Cl_2$ or HCl). The primary control employed for maintaining the desired solution concentrations is the feed rate of sodium chloride brine to the first cell in the series. Other control means include the addition of water, sodium chloride brine or solid salt to the remaining cells in the series or to the product collection tank. The continuous electrolytic process can be operated most efficiently when the concentration of the chlorate and chloride ions in the electrolytes from any of the electrolytic cells or the product collection tank can be maintained within the desired concentration ranges by efficient utilization of the process controls. Up until now, this has been seriously hampered by the lack of a method for rapidly and accurately determining the chlorate ion concentration and/or the chloride ion concentrations where both ions are present in the substantial concentrations. In the process of the present invention, samples of the electrolyte at any stage of the process can be accurately analyzed for the chlorate ion and chloride ion concentrations by feeding a sample of the electrolyte or product solution to an analyzer 26 such as a liquid chromatograph. The liquid chromatograph employs as the column packing any packing material suitable for use for reverse-phase liquid chromatography. Examples include bonded phase packings having as the functionality octadecylsilane, octylsilane, dimethylsilane, cyclohexane, polystyrene-divinyl benzene and phenyl groups. Preferred as the column packing are packings having as the functionality octylsilane or octadecylsilane groups with octadecylsilane groups being particulary preferred. Eluent solutions employed include any which are suitable for ion-pairing applications, for example, aqueous solutions of acetonitrile, methanol, or propanol. The counter-ion employed in the eluent can be provided by tetrabutyl ammonium, hexadecyl (trimethyl) ammonium or tri-n-octylamino groups.

Preferred as an eluent is an aqueous solution of acetonitrile and tetrabutyl ammonium hydroxide containing acetic acid as a buffering agent.

The eluent for the liquid chromatograph is continuously pumped from a reservoir through a sample valve, separating column, conductivity detector and back to the reservoir.

The aqueous solution containing chlorate and chloride ions in high concentrations is pumped from the chlorate cell or product collection tank to the sample valve of the liquid chromatograph. Periodically, a sample is injected into the continuously flowing eluent solution. The ions are separated through a mechanism of adsorbtion/desorbtion with the eluent and column packing. This mechanism results in a finite and specific retention of each ion in the column. The ions are eluted from the column separately (chloride ions first) and through the conductivity detector. The concentration of each ion is measured by the conductivity detector.

Thus the chlorate ion and the chloride ion of the electrolytes and product solution can be continously monitored as the column does not require frequent shutdowns for regeneration or operation in tandem with an additional column as required by other ion exchange methods. Further the novel process of the present invention does not require dilution of the electrolyte prior to injection into the column. The determinations are recorded on a visual record such as a strip chart or video display and made available to operators who can adjust the control valves as necessary to alter the brine feed to the first cell in the series or add water or brine to the other cells in the series or to the product collection tank. In a preferred embodiment, the conductivity determinations are fed to a processor which compares the conductivity measurements with predetermined conductivity ranges and employs means for adjusting the control valves, as illustrated on FIG. 1, to alter the brine, water, or solid salt feed rate to the cell or product collection tank.

In commercial processes which employ a large electrolytic cell or a series of electrolytic cells, the residence time for the chlorate solution is considerable. A change, for example, in the flow rate of brine from brine feed tank 10 to chlorate cell 22, which is the primary process control, will not rapidly alter the concentration of chlorate in the electrolyte. Where a more rapid change in the chlorate concentration is desired, for example, during upset conditions, secondary process controls can be employed. Changing the current load to the cell can more readily alter the chlorate and chloride concentration of the electrolyte. Thus upon comparison of the analytical results from analyzer 26 with the predetermined values retained by processor 28, means may be employed by processor 28 to change the current load to the electrolytic cells or to adjust the brine feed by control valve 16 according to the applied current load to the cells. To increase the chlorate concentration, the current load is increased. Other secondary process controls include the direct addition of water, brine or solid salt as discussed above.

Any suitable processor 28 can be employed in the process of the present invention which can determine the chlorate-chloride concentration ratios from the data provided by the solution analyzer and have proportional controllers for control valves or other control means. Examples of processors which can be employed include Foxboro Microspec System (Foxboro Company, Foxboro, MA), Fischer-Porter DCI 4000 System (Fischer-Porter Company, Warminster, PA), Honeywell JDC 2000 (Honeywell, Inc., Minneapolis, MN), and Texas Instruments TI-550 System (Texas Instruments, Inc., Dallas, TX).

The novel process of the present invention permits the continuous operation of the electrolytic cells by frequently and rapidly determining the chlorate and chloride concentrations and permitting small adjustments to the various feed streams or the current load to maintain the product solution within the required concentration without the long delays required for methods of analysis previously employed.

The novel process of the present invention is further illustrated by the following EXAMPLES without being limited thereby.

EXAMPLE 1

A solution containing 25 grams per liter of sodium chlorate and 10 grams per liter of sodium chloride was prepared. The method employed as an eluent an aqueous solution of acetonitrile (15 percent by volume) and tetrabutyl ammonium hydroxide (0.015 M) adjusted to a pH of 5.9 by the addition of acetic acid. Periodically about 10 microliters of the $NaClO_3$-NaCl solution were injected by the sample valve into the eluent stream and passed through the liquid chromatography column at a rate of 5 mls/min. The system consisted of a C18 (octadecyl silane) column in a Waters RCM-100 Radial-Pak. Chlorate ions and chloride ions were separated along the column packing. The chloride ion concentration was measured by a conductivity detector (Vydac Model 6000 CD) and the peak area integrated on an electronic integrator (Hewlett-Packard 3354) and recorded. Subsequently the chlorate ion concentration was determined in the same manner.

Figure 2:
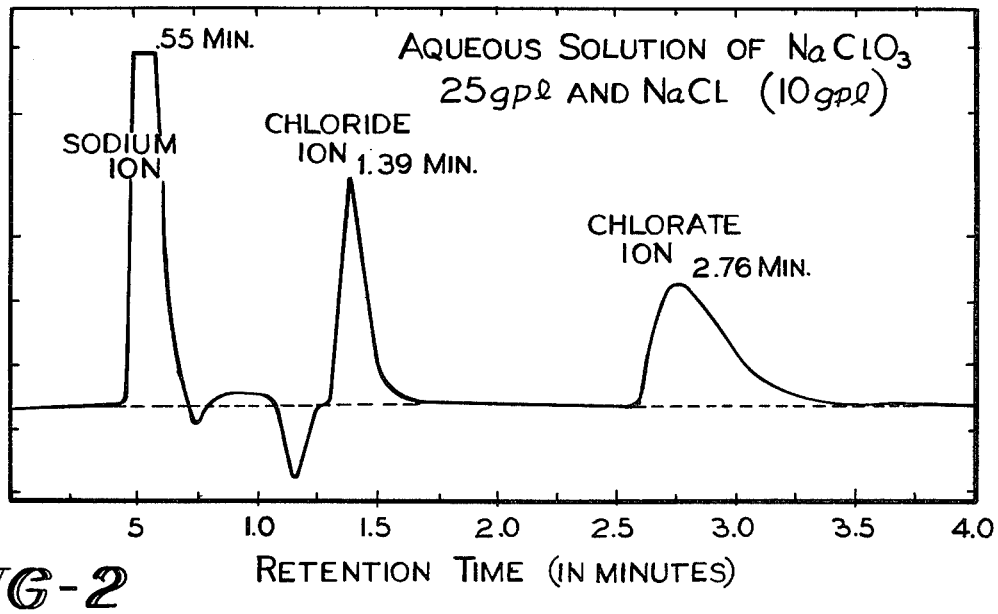
FIG. 2 is a chromatogram depicting the separation of chloride ions and chlorate ions obtained employing the process of the invention.

Ten repeat analyses for the solution gave an average peak area of 22969 for the chloride ion concentration and an average peak area of 36857 for the chlorate ion concentration with a 1 sigma relative error of 1.3% for each of the ions. The retention time for chloride ions was 1.40 minutes and for the chlorate ions 2.90 minutes. The analysis for one sample is illustrated on FIG. 2.

EXAMPLE 2

A solution containing 50 gpl sodium chloride and 575 gpl sodium chlorate was prepared. The solution continuously flowed through a sample valve. The system consisted of a liquid chromatography column C18 (octadecyl silane) in a Waters RCM-100 Radial-Pak. The system employed as an eluent 0.015 M tetrabutylammonium hydroxide aqueous solution with 8 percent acetonitrile and adjusted to a pH of 5.9 by the addition of acetic acid. A cycle timer was employed to automatically operate the sample valve. Periodically 0.5 ul of the $NaClO_3$-NaCl solution was injected into the eluent and passed through the liquid chromatography column at a rate of 5 ml/min. The chloride and chlorate ions were separated by the chromatography column and as the chloride eluded from the column its concentration was measured as a function of conductivity by use of a conductivity detector (Vydac Model 6000 CD) and the peak height was recorded. The same was done for the chlorate ion. Ten repeat analyses for the solution yielded a 1 sigma relative error at 1.5 percent for each chloride and chlorate. The sample valve, liquid chromatography column and conductivity detector were housed in a heated chamber maintained at 40° C. The analytical results for the samples 1–10 are found below in Table 1.

TABLE 1

| Sample | Peak Height Chloride Ion (50 gpl) | Chlorate Ion (575 gpl) |
|---|---|---|
| 1 | 28 | 88 |
| 2 | 27 | 89 |
| 3 | 29 | 88 |
| 4 | 31 | 86 |
| 5 | 30 | 87 |
| 6 | 29 | 89 |
| 7 | 28 | 90 |
| 8 | 27 | 90 |
| 9 | 30 | 89 |
| 10 | 31 | 86 |
| Average | 29 | 88.2 |

What is claimed is:

1. A process for producing a concentrated aqueous solution comprised of an alkali metal chlorate and an alkali metal chloride, the process which comprises:
   - feeding an aqueous alkali metal chloride solution to a first electrolysis zone at an initial feed rate;
   - electrolyzing the aqueous alkali metal chloride to produce a concentrated chlorate solution comprised of an alkali metal chlorate and the alkali metal chloride;
   - feeding a portion of said concentrated chlorate solution to an analysis zone;
   - analyzing said aqueous solution to measure the ratio of the concentration of the chlorate ion to the concentration of the chloride ion;
   - comparing in a processing zone said measured ratio with a predetermined value range for said ratio, and where said measured ratio falls outside of the predetermined value range for the ratio, altering the initial feed rate of said alkali metal chloride to said first electrolysis zone; and
   - removing said concentrated alkali metal chlorate solution from said first electrolysis zone to a product solution collection zone.

2. A process for producing a concentrated aqueous solution comprised of an alkali metal chlorate and an alkali metal chloride, the process which comprises:
   - feeding an aqueous alkali metal chloride solution to a first electrolysis zone at an initial feed rate;
   - electrolyzing the aqueous alkali metal chloride to produce a first chlorate solution comprised of an alkali metal chlorate and the alkali metal chloride;
   - feeding said first chlorate solution to a second electrolysis zone;
   - electrolyzing said first chlorate solution to produce a concentrated chlorate solution comprised of the alkali metal chlorate and the alkali metal chloride;
   - feeding a portion of an aqueous solution selected from the group consisting of said first chlorate solution and said concentrated chlorate solution to an analysis zone;
   - analyzing said aqueous solution to measure the ratio of the concentration of the chlorate ion to the concentration of the chloride ion;
   - comparing in a processing zone said measured ratio with a predetermined value range for said ratio, and where said measured ratio falls outside of the predetermined value range for the ratio, altering the initial feed rate of said alkali metal chloride to said first electrolysis zone; and removing said concentrated alkali metal chlorate solution from said second electrolysis zone to a product solution collection zone.

3. The process of claim 1 or 2 in which said alkali metal chloride is sodium chloride and said chlorate is sodium chlorate.

4. The process of claim 3 in which said concentrated chlorate solution contains at least 300 grams per liter of said sodium chlorate and at least 90 grams per liter of said sodium chloride.

5. The process of claim 4 in which said analysis zone comprises a liquid phase chromatograph.

6. The process of claim 5 in which said liquid phase chromatograph comprises a column containing an alkyl silane selected from the group consisting of octadecyl silane and octyl silane.

7. The process of claim 6 in which said concentration of said chlorate ions and said chloride ion is determined by a conductivity detector.

8. The process of claim 7 in which said liquid phase chromatograph is operated in the reverse phase.

9. The process of claim 8 in which the eluent is comprised of an aqueous solution of acetonitrile and tetrabutyl ammonium hydroxide.

10. The process of claim 3 in which said aqueous solution is selected from the group consisting of said first chlorate solution and said concentrated chlorate solution and where said measured ratio is outside of said predetermined value, feeding a compound selected from the group consisting of water, an aqueous solution of sodium chloride or solid sodium chloride to said first electrolysis zone or said second electrolysis zone.

11. The process of claim 3 in which said aqueous solution is said product solution and where said measured ratio is outside of said predetermined value, feeding a compound selected from the group consisting of water, in aqueous solution of sodium chloride, or solid sodium chloride to said product solution collection tank.

* * * * *